US007793419B2

(12) United States Patent
Maxim

(10) Patent No.: US 7,793,419 B2
(45) Date of Patent: Sep. 14, 2010

(54) CUTTING AND FORMING TOOL ASSEMBLY

(75) Inventor: John Maxim, Greenacres, FL (US)

(73) Assignee: Crayola, LLC, Easton, PA (US)

( * ) Notice: Subject to any disclaimer, the term of this patent is extended or adjusted under 35 U.S.C. 154(b) by 500 days.

(21) Appl. No.: 11/644,628

(22) Filed: Dec. 22, 2006

(65) Prior Publication Data

US 2007/0175046 A1 Aug. 2, 2007

Related U.S. Application Data

(60) Provisional application No. 60/753,325, filed on Dec. 22, 2005.

(51) Int. Cl.
*B26B 7/00* (2006.01)
*B26D 1/00* (2006.01)

(52) U.S. Cl. ..... 30/392; 30/164.9; 30/165; 30/277.4; 74/22 R

(58) Field of Classification Search ..... 30/164.9, 30/165, 272.1, 277.4, 392–394; 74/20, 21, 74/22 A, 22 R, 23, 24, 89, 569, 606 R; 72/449, 72/450, 452.5; 29/90.3; 173/114, 205; 408/124, 408/138

See application file for complete search history.

(56) References Cited

U.S. PATENT DOCUMENTS 1,505,493 A * 8/1924 Roberts ..... 173/205
2,307,424 A * 1/1943 Savage ..... 30/277.4
2,710,000 A * 6/1955 Cromer et al. ..... 600/567
2,858,701 A * 11/1958 Willcox ..... 74/22 R
3,173,210 A * 3/1965 Allemann ..... 409/79
3,260,289 A * 7/1966 Whitten, Jr. ..... 30/392
3,448,781 A * 6/1969 Angelucci ..... 30/392
3,585,669 A * 6/1971 Moret et al. ..... 15/22.1
3,661,018 A * 5/1972 Keefer et al. ..... 74/22 R
3,841,416 A * 10/1974 Pfister ..... 173/31
4,249,617 A * 2/1981 Cox, Jr. ..... 173/170
4,255,858 A * 3/1981 Getts ..... 30/393
4,397,055 A * 8/1983 Cuchiara ..... 15/22.1
5,165,488 A * 11/1992 Liu ..... 173/49
5,676,497 A * 10/1997 Kim ..... 408/21
5,836,403 A * 11/1998 Putney et al. ..... 173/205
2007/0089301 A1 * 4/2007 Arias et al. ..... 30/277.4
2008/0083121 A1 * 4/2008 Cziraky et al. ..... 30/277.4

* cited by examiner

*Primary Examiner*—Hwei-Siu C Payer
(74) *Attorney, Agent, or Firm*—Shook, Hardy & Bacon, L.L.P.

(57) ABSTRACT

A cutting and forming tool assembly is disclosed that cuts and forms many types of material while remaining easy to use. The tool assembly may include a cutting or forming and an underlying board. The cutting and forming tool has a drive assembly and a shaft assembly contained within a housing. The shaft assembly of the tool assembly reciprocates and at least partially rotates during each reciprocating motion. The housing may be of various shapes and configurations, such as for example egg-shaped, computer mouse-shaped, or pen-shaped. The drive shaft contains a tip that protrudes from an opening in a lower portion of the housing during at least a portion of a downward stroke of the shaft assembly.

12 Claims, 15 Drawing Sheets

CUTTING AND FORMING TOOL ASSEMBLY

CROSS-REFERENCE TO RELATED APPLICATIONS

This application claims the benefit of U.S. Provisional Application No. 60/753,325, filed on Dec. 22, 2005, which is incorporated herein by reference.

STATEMENT REGARDING FEDERALLY SPONSORED RESEARCH OR DEVELOPMENT

Not applicable.

BACKGROUND OF THE INVENTION

This invention relates to a tool assembly for use in cutting and forming various materials. More specifically, the invention relates to a toy cutting tool and underlying board assembly for cutting or forming different types of material.

Safety scissors are commonly used by children for cutting different types of material. Safety scissors, however, are difficult for children to effectively cut designs. Thus they may be frustrating for a child to use, especially a young child.

BRIEF SUMMARY OF THE INVENTION

Accordingly, the present invention provides a cutting and forming tool assembly that cuts and forms many types of material while remaining easy to use. The tool assembly may include a cutting tool, a forming tool and an underlying board. The cutting and forming tool has a drive assembly and a shaft assembly contained within a housing. The housing may be of various shapes and configurations, such as for example egg-shaped, computer mouse-shaped, or pen-shaped. The drive shaft contains a tip that protrudes from an opening in a lower portion of the housing. In use, the drive assembly drives the shaft assembly to cut or form various types of material. The underlying board may be used to facilitate the cutting or forming of various designs.

Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figures 1, 1A:
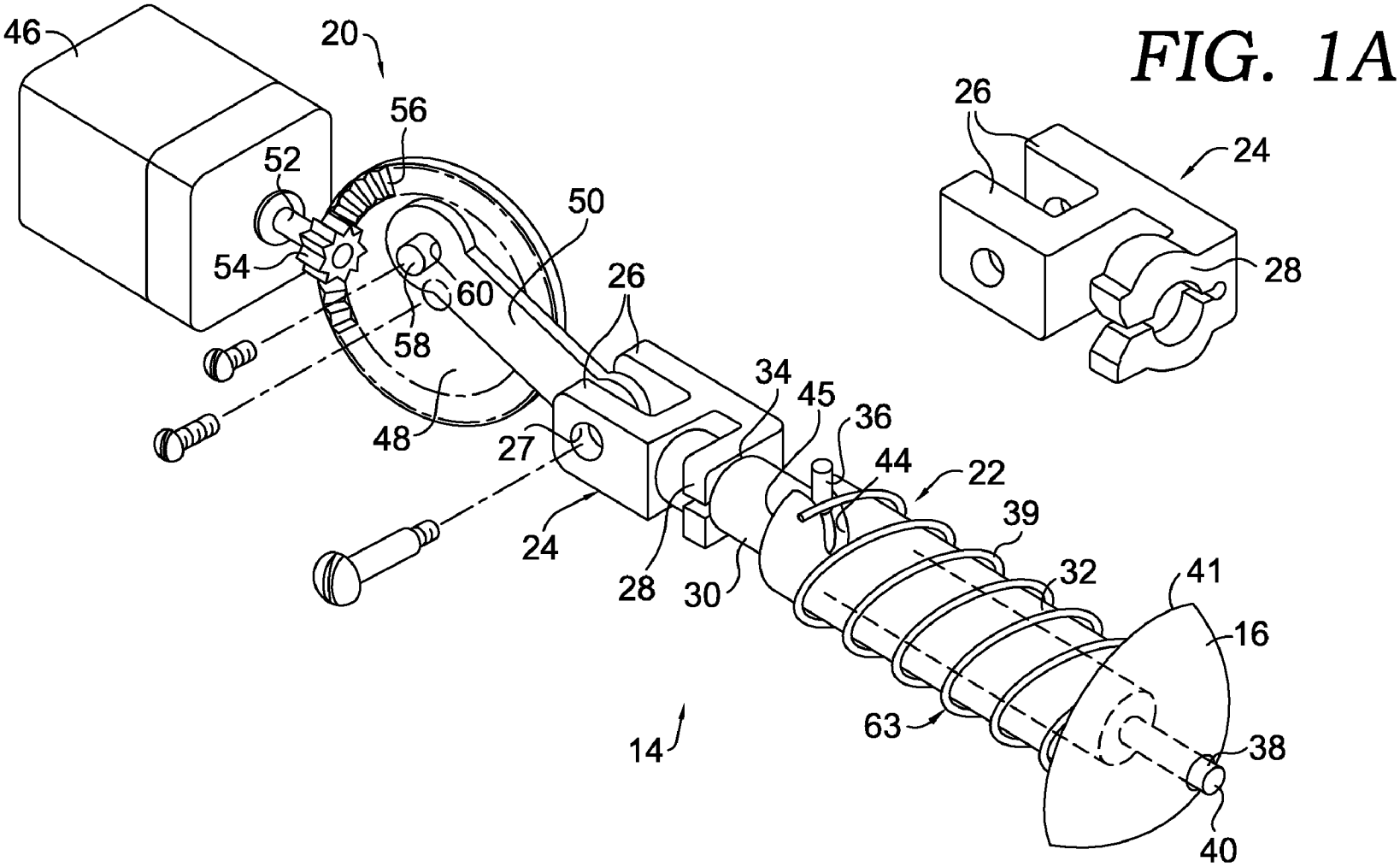
FIG. 1 is a view of the inner mechanism showing individual parts.
FIG. 1A is a perspective view of an attachment assembly in accordance with an embodiment of the invention.
Figure 2:
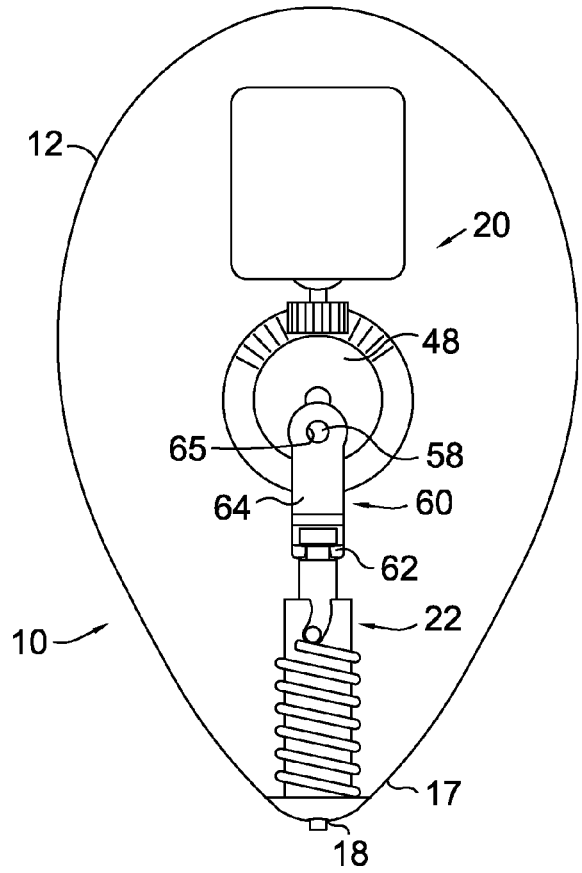
FIG. 2 is a cross-sectional view of an alternative embodiment of the assembly.
Figure 3:
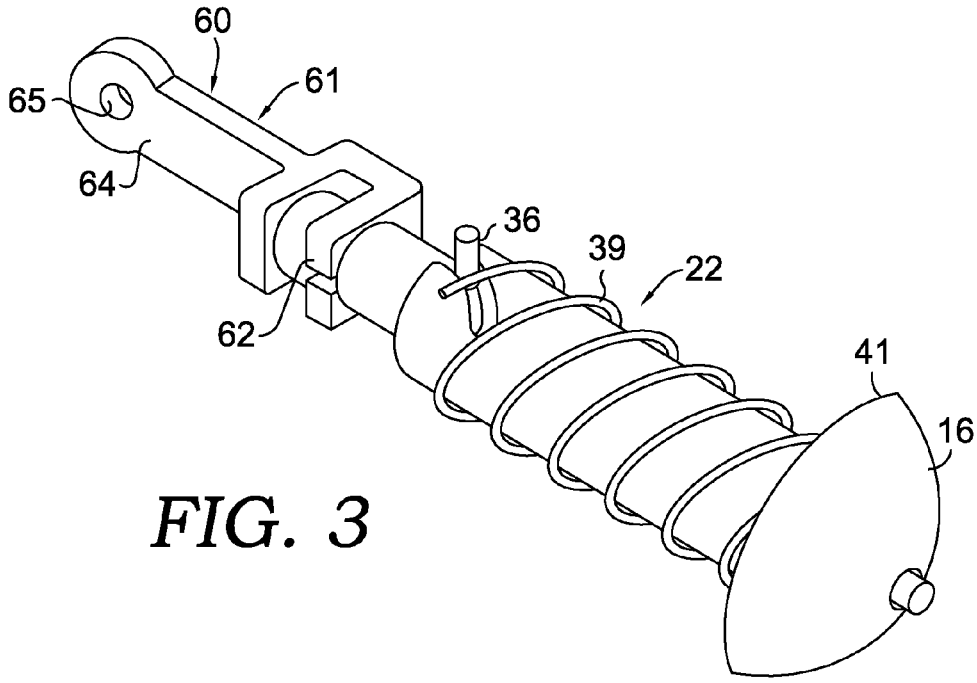
FIG. 3 is a view the attachment and drive assembly of the inner mechanism of FIG. 2.

Referring to the drawings in greater detail and initially to FIGS. 1-3, a first embodiment of a tool assembly for cutting and forming various materials is shown generally at 10. The tool assembly includes a cutting tool having a housing 12 and an inner mechanism 14 comprising a drive assembly 20, a shaft assembly 22, and an attachment assembly 24. The drive assembly 20 and the shaft assembly 22 are operably coupled by the attachment assembly 24, which in one embodiment comprises a drive attachment portion 26 and a shaft attachment portion 28.

The housing 12 may be of various shapes and sizes as will be discussed hereinafter, but in a first exemplary embodiment is egg-shaped as shown in FIG. 2. The lower portion of the housing is formed with a tip portion 17 having an opening 18. The housing 12 further includes a power switch (not shown) mounted in the housing to actuate the drive assembly.

The shaft assembly 22 includes a reciprocating shaft 30 and a shaft guide 32 disposed longitudinally within housing 12. The reciprocating shaft 30 is generally cylindrical and has a circumscribing groove 34 along an upper portion of the shaft. This groove 34 is formed to be received within the shaft attachment portion 28, as shown in FIG. 1. The shaft 30 further may include a pair of opposed guide members 36 projecting outwardly from the upper portion of the reciprocating shaft 30. These members are received in the shaft guide 32 as will be described hereafter. The shaft 30 terminates in a cutting tip 38, which at some portion of a downward stroke of the shaft extends through the opening 18 of the housing 12. The cutting tip 38 may include a concave distal end 40, which facilitates the cutting and removal of material from the tip, as will be described hereinafter. This embodiment is particularly useful in cutting materials such as cloth, which may bind to a constant rotation embodiment that will be described hereinafter.

Figure 22:
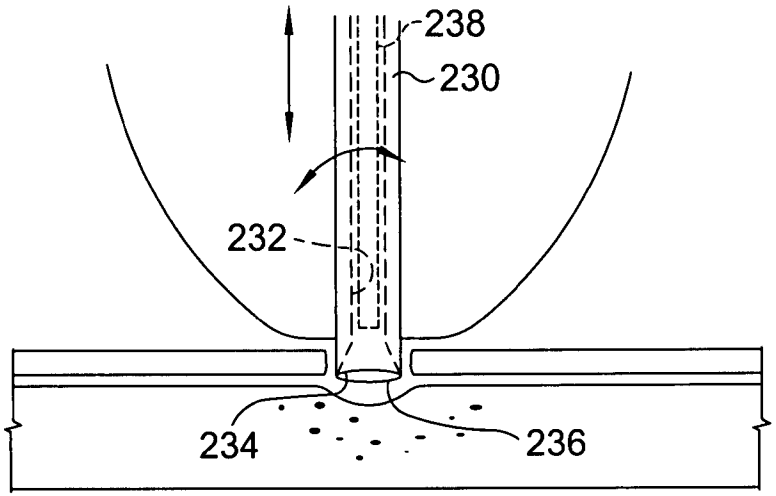
FIG. 22 is a view of an alternate cutting tip for a shaft assembly of the present invention.
Figure 23:
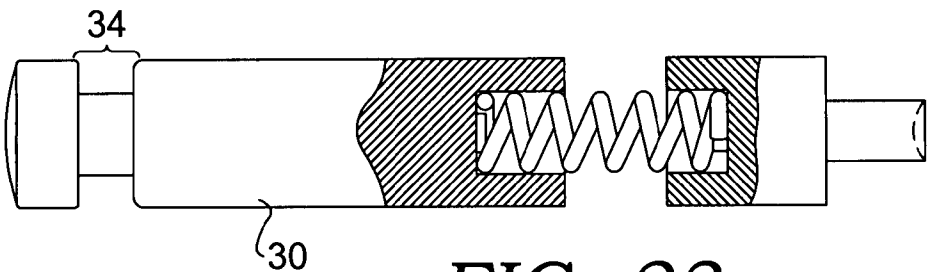
FIG. 23 is a side elevational view of the shaft assembly of FIG. 1 having a force limiting mechanism.

Alternatively, as shown in FIG. 22, a shaft 230 may be tubular. In this embodiment, shaft 230 defines a bore 232 extending therethrough and terminates in an inwardly raked terminating end 234. The outer peripheral edge 236 of the terminating end 234 has a sharp edge to facilitate cutting of the material. The shaft 230 further includes a stationary push rod 238 mounted or formed internally of the shaft 230. As the shaft reciprocates in a generally vertical plane and rotates around the longitudinal axis of the shaft, the push rod 238 remains stationary. Any material that may get caught in the bore 232 of the tubular shaft will contact the push rod 238 on the upstroke of the reciprocating motion and be dislodged from the shaft.

It will be understood that other tips, such as forming tips, may be included with this embodiment as will be described in greater detail hereinafter.

The shaft guide 32 likewise is generally cylindrically shaped and defines an aperture therethrough that receives reciprocating shaft 30. The shaft guide 32 is disposed proximate the tip 17 of the housing 12 and is formed with a pair of opposed guide grooves 44 operably configured to receive guide members 36 of the reciprocating shaft 30. Guide grooves 44 extend downwardly from an upper edge 45 of shaft guide 32 in a generally arcuate path. The opposing grooves 44 both curve in either a clockwise or counterclockwise direction. The shaft guide further includes an enlarged tip end 16 operably configured to abut the tip portion 17 of the housing 12. Tip end 16 may be formed of a weighted material, such as copper, to provide a weighted feel for the assembly and help in preventing the apparatus from bouncing or jolting while in use.

The shaft assembly 22 may include a spring-biasing means for biasing the cutting tip 38 of the shaft 30 inwardly of the housing. As shown in FIG. 1, spring 39 is operably configured to surround shaft guide 32 and abut an inwardly facing surface 41 of tip end 16 at one end of the spring and the opposing guide members 36 at an other end of the spring. As such, when the motor is disengaged, the spring biases the shaft and particularly cutting tip 38 inwardly with respect to the housing 12.

The shaft assembly may further include a force limitation means 63 for the apparatus for limiting the force of the cutting tip 38 as it exits the housing 12. The force limitation means 63 may comprise a spring or rubber bushing mounted on the shaft assembly 22 or between the shaft assembly 22 and the drive assembly 20 to limit the force such as the spring 39. As shown, the shaft 30 comprises a first end and a second end and the spring 39 is mounted therebetween. The force of the drive assembly 20 is limited by the spring 39 and thus the cutting tip 40 has a reduced force as it exits the housing 12.

The attachment assembly 24 of the tool assembly 10 couples the drive assembly 20 to the shaft assembly 22 while not inhibiting the rotation of the reciprocating shaft 30. The drive attachment portion 26 of the attachment assembly 24 has an aperture 27 that couples the attachment assembly 24 to an offset rod 58 of a disc gear 48 via a drive shaft 50. The shaft attachment portion 28 is operably configured to receive the groove of the shaft 30. The shaft attachment portion 28 is operably configured to rotatably receive and secure the shaft 30.

FIGS. 2 and 3 illustrate an alternative embodiment of an attachment assembly 60. This embodiment essentially combines the drive shaft 50 with the attachment assembly 24 of FIG. 1 to create the attachment assembly 60. In this embodiment, a shaft attachment portion 62 is essentially unchanged from the previous embodiment and a drive attachment portion 61 includes a drive shaft portion 64 that terminates in a shaft attachment portion 65, which is operably configured to receive the offset rod 58 of the disc gear 48.

The drive assembly 20 of the tool hand may be battery or electrically powered and includes a motor 46, the disc gear 48, and the drive shaft 50. In a battery powered embodiment, the batteries may be housed in housing 12 to provide a non-tethered portable apparatus, or, alternatively, may be housed in an underlying board, which is discussed hereinafter, or a separate power base (not shown). Motor 46 includes an output axle 52 with a drive gear 54 coupled thereto. The drive gear 54 engages the disc gear 48 at a gear path 56 along its circumferential edge. The disc gear 48 further includes the offset rod 58 projecting from a side surface. Drive shaft 50 contains a pair of apertures 60 located at each end thereof with one of the apertures being operably configured to receive the offset rod 58 on the disc gear 48 and the other aperture being operably configured to be received in the drive attachment portion 26 of the attachment assembly 24. It should be appreciated that any other attachment method may be used without departing from the scope of the invention.

In operation, the drive gear 54 drives the disc gear 48, which rotates about its center to propel drive shaft 50, which is coupled to the offset shaft 58. Drive shaft 50 drives shaft 30 in a reciprocating manner. As the reciprocating shaft 30 moves downwardly, the guide members 36 are constrained within the guide grooves 44, which in turn cause the reciprocating shaft 30 to rotate along its longitudinal axis in a clockwise manner when viewed from the tip for the embodiment shown in FIG. 2. The clockwise rotation of the reciprocating shaft 30 likewise causes the cutting tip 38 to rotate in a clockwise manner. Conversely, as the reciprocating shaft 30 moves upwardly during the return stroke of the embodiment shown in FIG. 2, the guide members 36 move upwardly within the guide grooves 44 and cause the reciprocating shaft 30 to rotate in a counterclockwise manner. The counterclockwise rotation of the reciprocating shaft 30, in turn, causes the cutting tip 38 to rotate in a counterclockwise manner. It is to be understood that the guide grooves may extend in the opposite direction than shown in FIG. 2, which would cause the shaft and the cutting tip to twist in a counterclockwise direction.

Figure 15A:
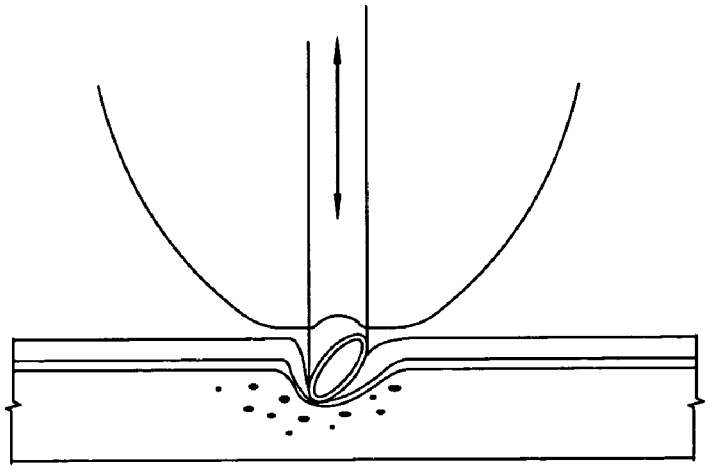
FIGS. 15A and 15B includes views of the cutting action of the apparatus of the present invention in use.
Figure 15B:
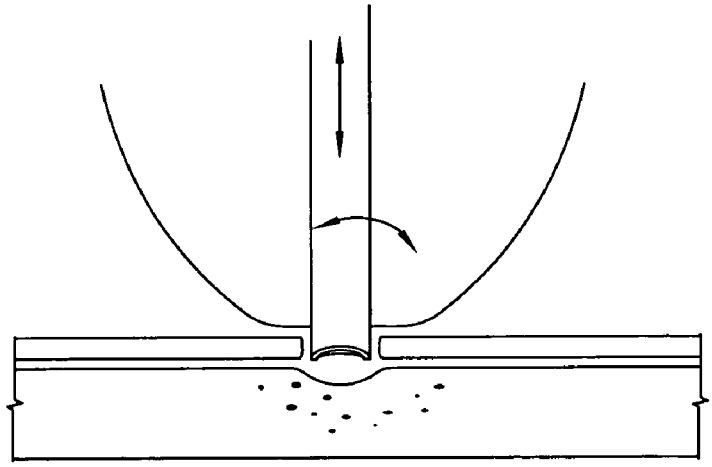

FIGS. 15A and B demonstrate the reciprocal and axial motion provided by the guide grooves. FIG. 15A shows a tool that cuts utilizing reciprocating motion. FIG. 15B shows a tool that utilizes both reciprocating and axial motion. The concave nature of the bottom surface of the pin captures the material being cut and the twisting motion helps facilitate the material's separation from the surrounding material. Upon counterclockwise motion on the upstroke, the material in the concave bottom is dislodged and the pin is in position to cut the material again.

Figure 4:
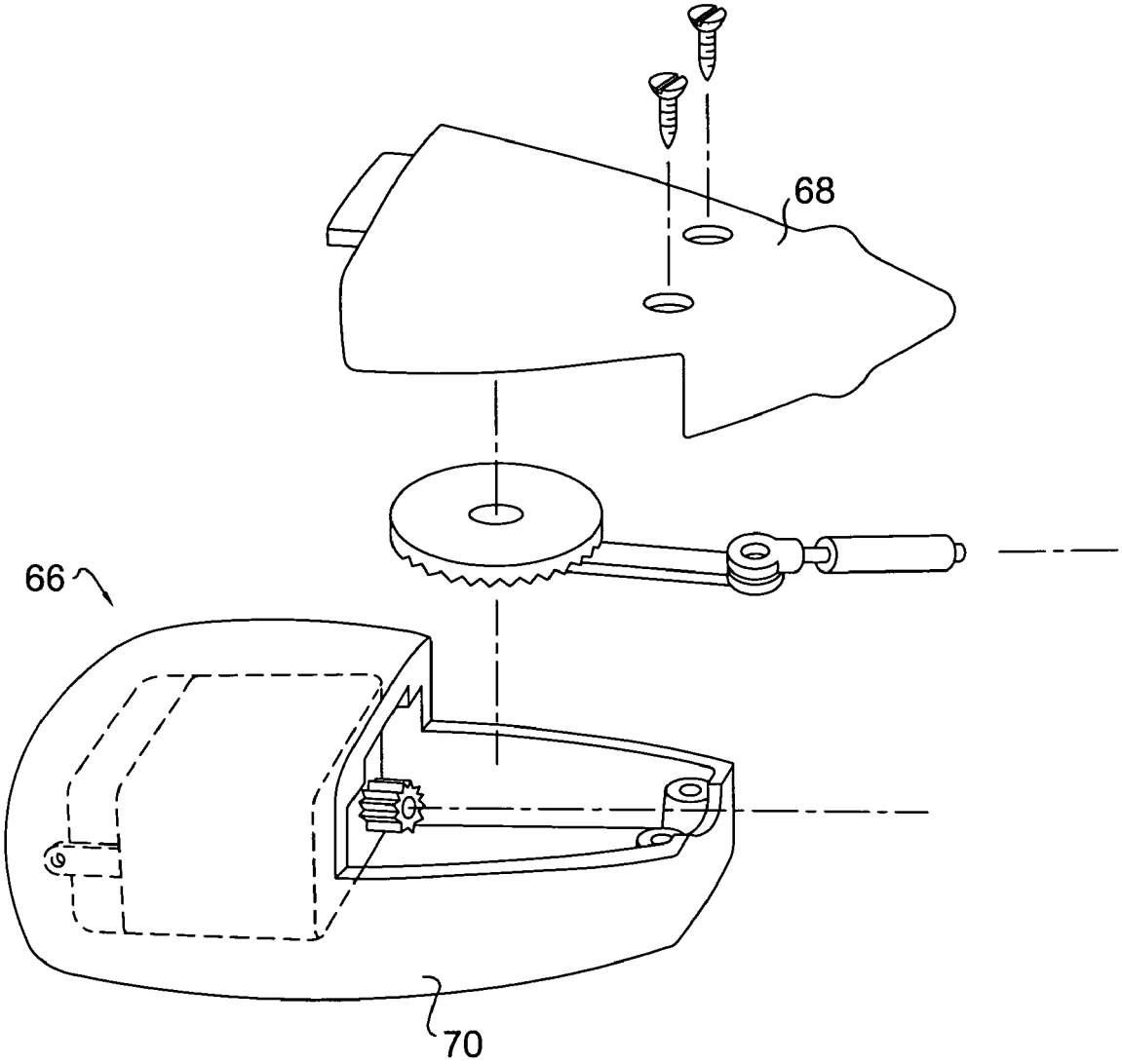
FIG. 4 is a view of an additional embodiment of a tool.

FIG. 4 illustrates another exemplary embodiment of a tool assembly 66. In this embodiment, the cutting tool assembly includes one or more tips 68 that each are selectively removable from a housing 70. Each tip 68 performs different functions, such as cutting, forming, or even welding and are interchangeably mountable to the housing 70. The housing 70 comprises two or more threaded bores operably configured to receive a screws to selectively secure the individual tip 68 to the housing 70. The operating components are virtually the same as the embodiments disclosed in FIGS. 1-3. The motor, output axle and drive gear are secured to the housing, while the disc gear, and a drive shaft and the shaft assembly of the other tips are mounted to the removable portion of the housing. The drive gear engages the disc gear at a gear path along its circumferential edge, when the removable tip portion of the housing is properly mounted to the housing.

Figure 5:
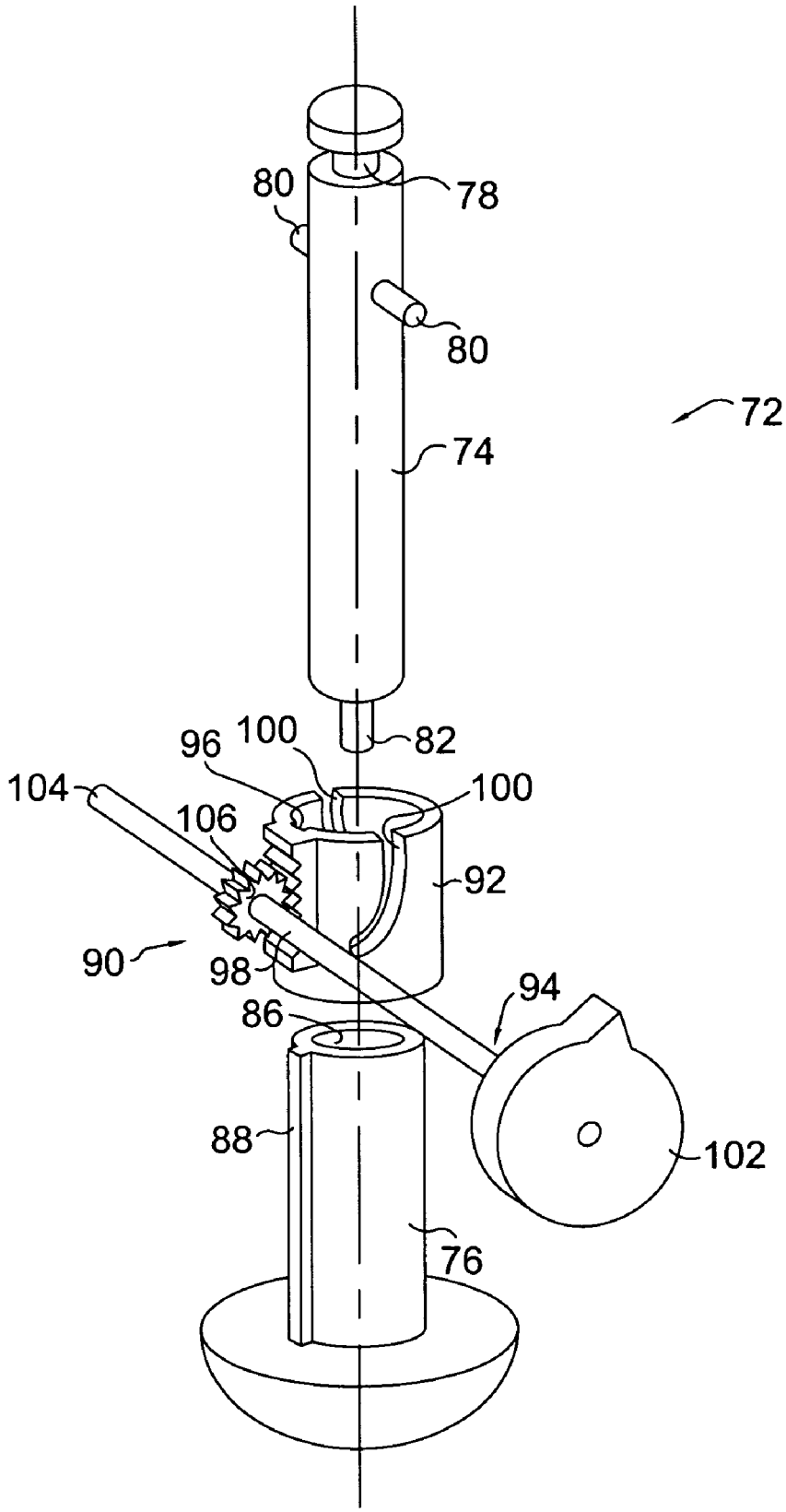
FIG. 5 is an additional embodiment of an inner mechanism showing an adjustment assembly for the degree of rotation of the cutting and forming assembly of the present invention.

FIG. 5 illustrates an embodiment of the present invention wherein the cutting tool assembly includes an adjustable axial rotation for the cutting tip. In this embodiment, an adjustable shaft assembly 72 replaces shaft assembly 22 disclosed above. The adjustable shaft assembly 72 may be connected to attachment assembly 60 or attachment assembly 24 discussed above. The adjustable shaft assembly 72 includes a reciprocating shaft 74 and a shaft guide 76. Both the reciprocating shaft 74 and shaft guide 76 are disposed longitudinally within the housing. The reciprocating shaft 74 is preferably cylindrical and comprises a circumscribing groove 78 along an upper portion thereof and a pair of opposed guide members 80 projecting outwardly therefrom. The lower portion contains a cutting tip 82 that protrudes downwardly therefrom. The cutting tip 82 includes a concave bottom surface, not shown. The shaft guide 76 is cylindrical and defines an aperture 86 operably sized and configured to receive the reciprocating shaft 74. The shaft guide 76 is disposed proximate the tip of the housing, not shown, and includes a projecting tab 88 along its length, the purpose of which will be described hereinafter.

The adjustable shaft assembly 72 includes an adjustment assembly, generally indicated at 90, for selectively adjusting the degree of axial rotation of the tip. The adjustment assembly 90 includes a collar 92 received on shaft guide 76 and a knob assembly 94. The collar 92 is cylindrical and contains an inner track 96, a gear rack 98, and a pair of opposed guide grooves 100. The inner track 96 receives the projecting tab 88 of the shaft guide 76 as the collar 92 is received thereon. The opposed guide grooves 100 receive guide members 80 of the reciprocating shaft 74 and guide the drive shaft 74 when in use. Both guide grooves 100 are slightly arcuate in either a clockwise or counterclockwise direction as the grooves extend downwardly from the top edge of the collar 92. Thus, as the reciprocating shaft 74 moves downwardly, the guide members 80 move downwardly within the guide grooves 100 and cause the reciprocating shaft 74 to rotate in a clockwise manner as viewed from the tip for the embodiment shown in FIG. 6. The clockwise rotation of the reciprocating shaft 74 as the shaft moves downwardly, in turn, causes the cutting tip 82 to rotate in a clockwise manner. Conversely, as the reciprocating shaft 74 moves upwardly the guide members 80 move upwardly within the guide grooves 100 and cause the reciprocating shaft 74 to rotate in a counterclockwise manner. The counterclockwise rotation of the reciprocating shaft 74, in turn, causes the cutting tip 82 to rotate in a counterclockwise manner.

The knob assembly 94 includes a knob 102, a shaft 104, and a gear 106. The gear 106 is received on the shaft 104 and is located at approximately the midpoint thereof. The gear 106 mates with rack 98 of the collar 92. The shaft 104 extends through the housing, not shown, and is rotatably coupled within a pair of apertures. The shaft 104 further includes an end portion that projects outwardly from the housing with the knob 102 coupled thereto. The knob 102 provides for adjustment of the rotation of the cutting tip 82 of the reciprocating shaft 74. Thus, as the knob 102 is turned, the gear 106 contacts the rack 98 to selectively move the collar 92 upwardly or downwardly with respect to the stroke of the reciprocating shaft 74. The movement of the collar 92 serves to limit the rotation of the guide members 80 within the guide grooves 100 and, thus, limits the rotation of the cutting tip 82. The rotation is limited because when the collar 92 is rotated downwardly with respect to the stroke of the reciprocating shaft 74, the guide members 80 only travel within a substantially vertical portion of the guide grooves 100 and thus tip 82 does not rotate. If the collar 92 is rotated upwardly, the guide members 80 travel within a more arcuately shaped portion of the guide grooves 100 thereby causing the degree of rotation of tip 82 to increase while the tip moves back and forth along the longitudinal axis. Thus, the assembly is adjustable from approximately 0 degrees of rotation to approximately 45 degrees of rotation. It will be understood that greater degrees of rotation may be realized without departing from the scope of the present invention. This embodiment may be used for either cutting or forming. In the forming mode, it is preferred to have zero rotation of the tip. Thus a cutting tip may be replaced with a forming tip, as described in greater detail hereinafter.

Figure 6:
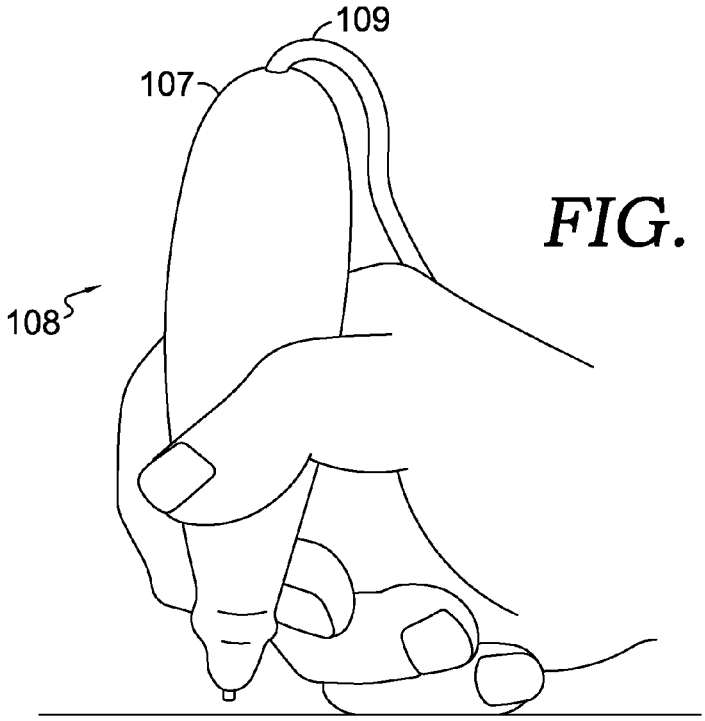
FIG. 6 is a view of an additional embodiment of a tool.
Figure 7:
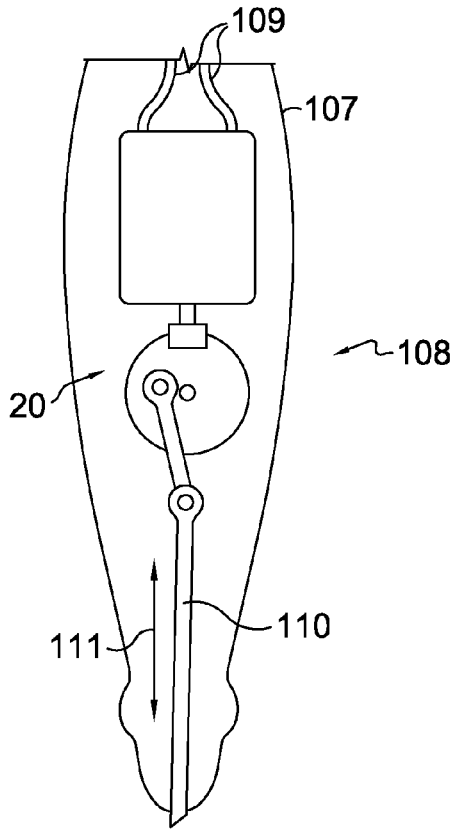
FIG. 7 is a view of the inner mechanism of the tool of FIG. 6.

FIGS. 6 and 7 show an additional embodiment of a housing 107 for a tool assembly 108 of the present invention. In this embodiment, the housing 107 of the tool assembly 108 is disposed at a ninety-degree angle with respect to the cutting surface. As previously described, the tool assembly 108 contains the drive assembly 20, a cutting shaft 110, and a connection to a power supply 109. The cutting shaft 110 is coupled with the drive assembly 20 and moves in a direction referenced by arrow 111.

Figure 8:
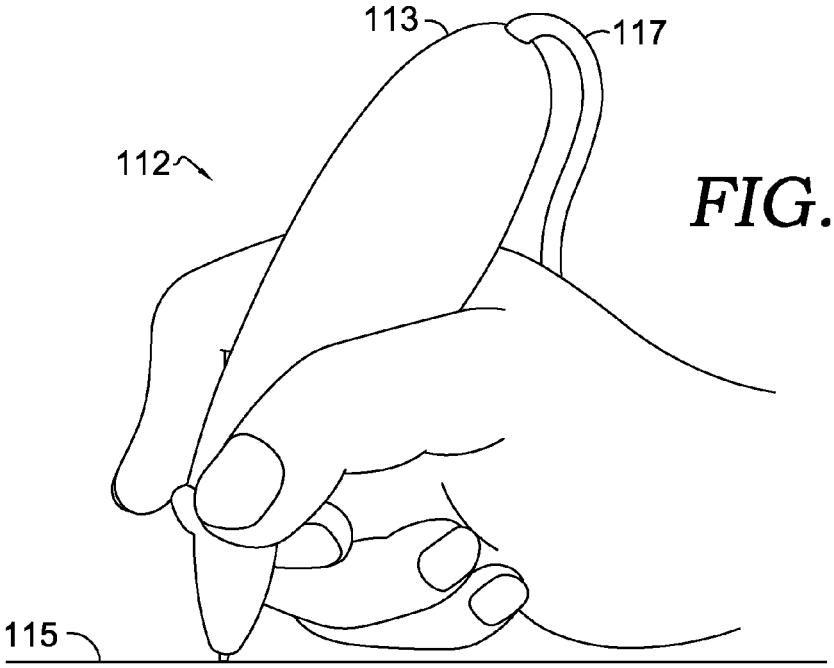
FIG. 8 is a view of an additional embodiment of a tool.
Figure 9:
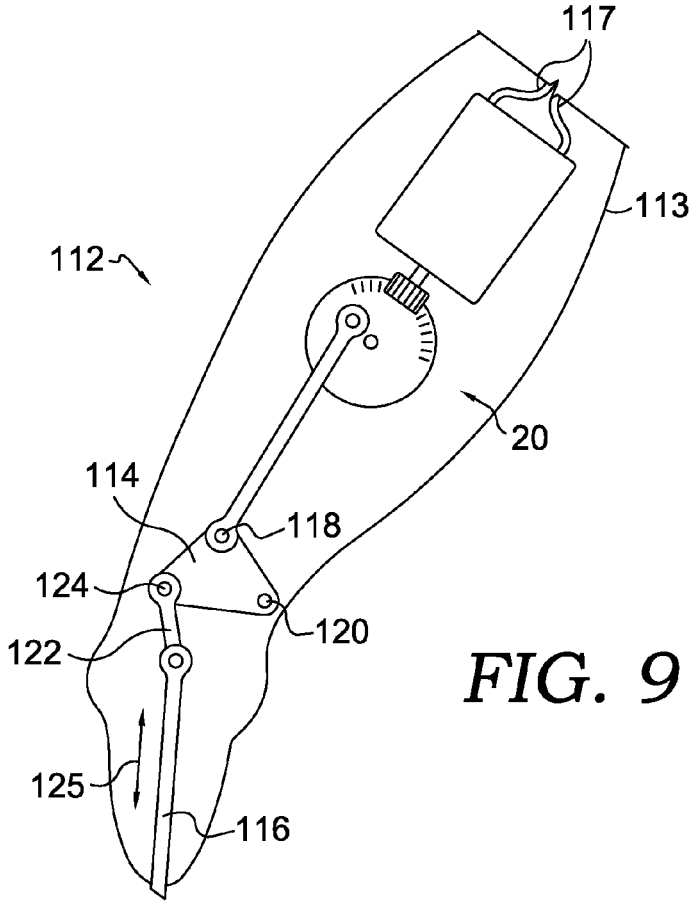
FIG. 9 is a cross-sectional view of the inner mechanism of the tool of FIG. 8.
Figure 10:
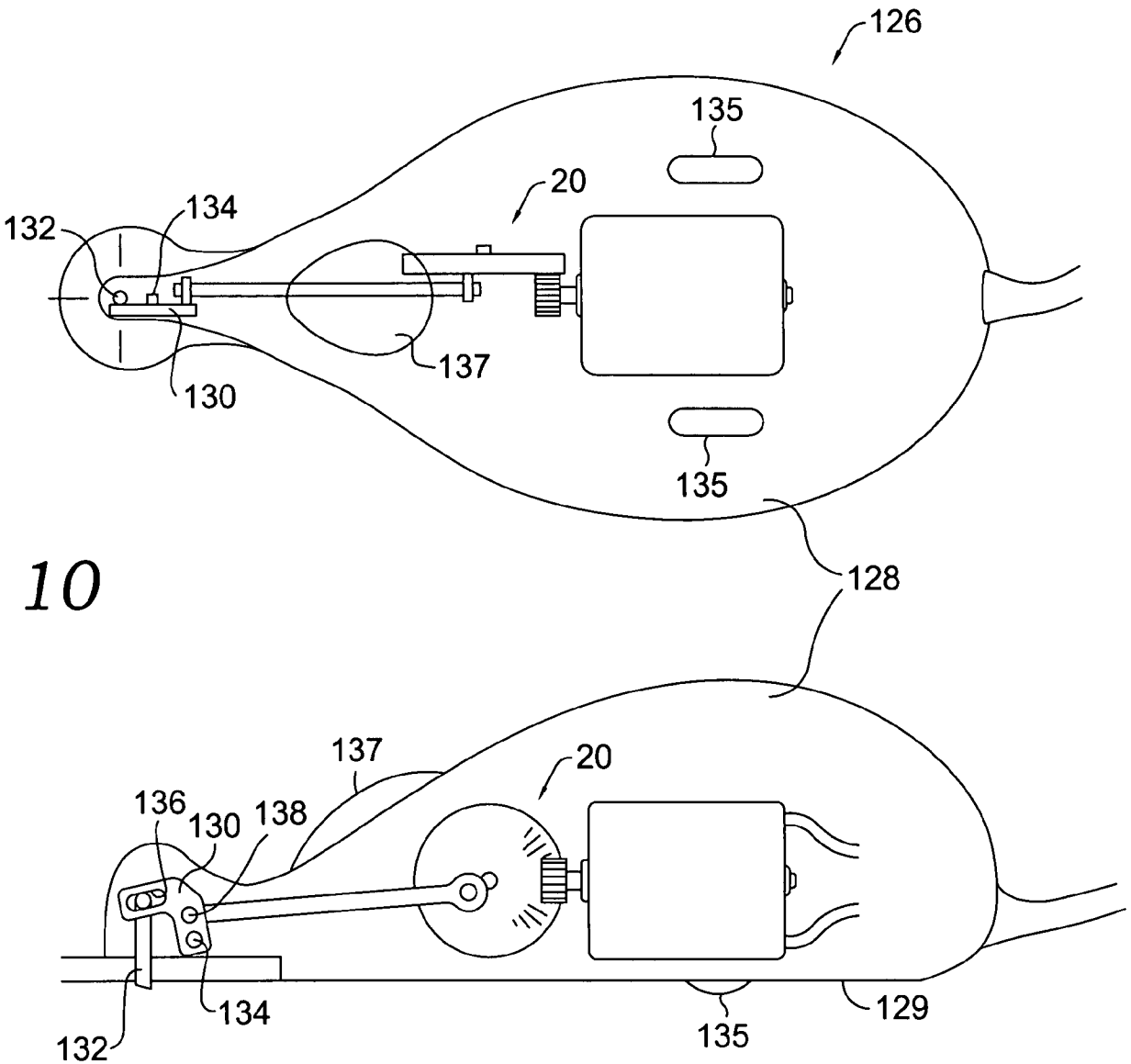
FIG. 10 includes views of an additional embodiment of a tool showing the inner mechanism.
Figure 11:
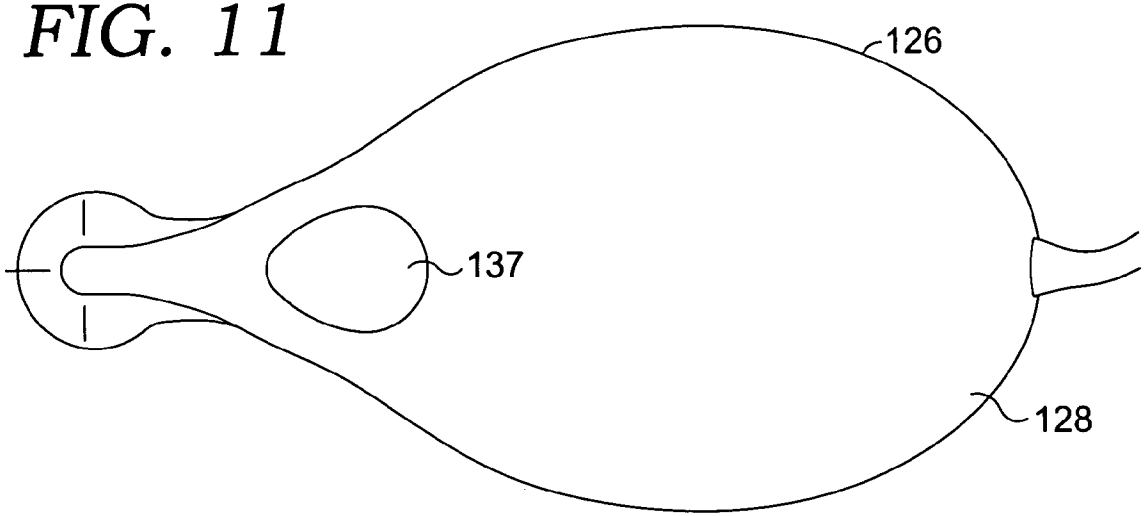
FIG. 11 includes additional views of the tool of FIG. 10.
Figure 12:
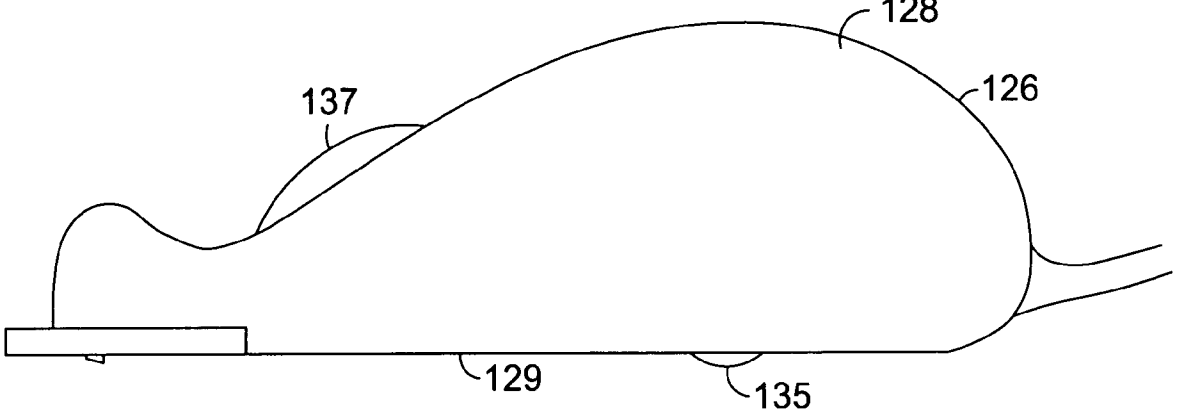
FIG. 12 includes additional views of the tool of FIG. 10.
Figure 13:
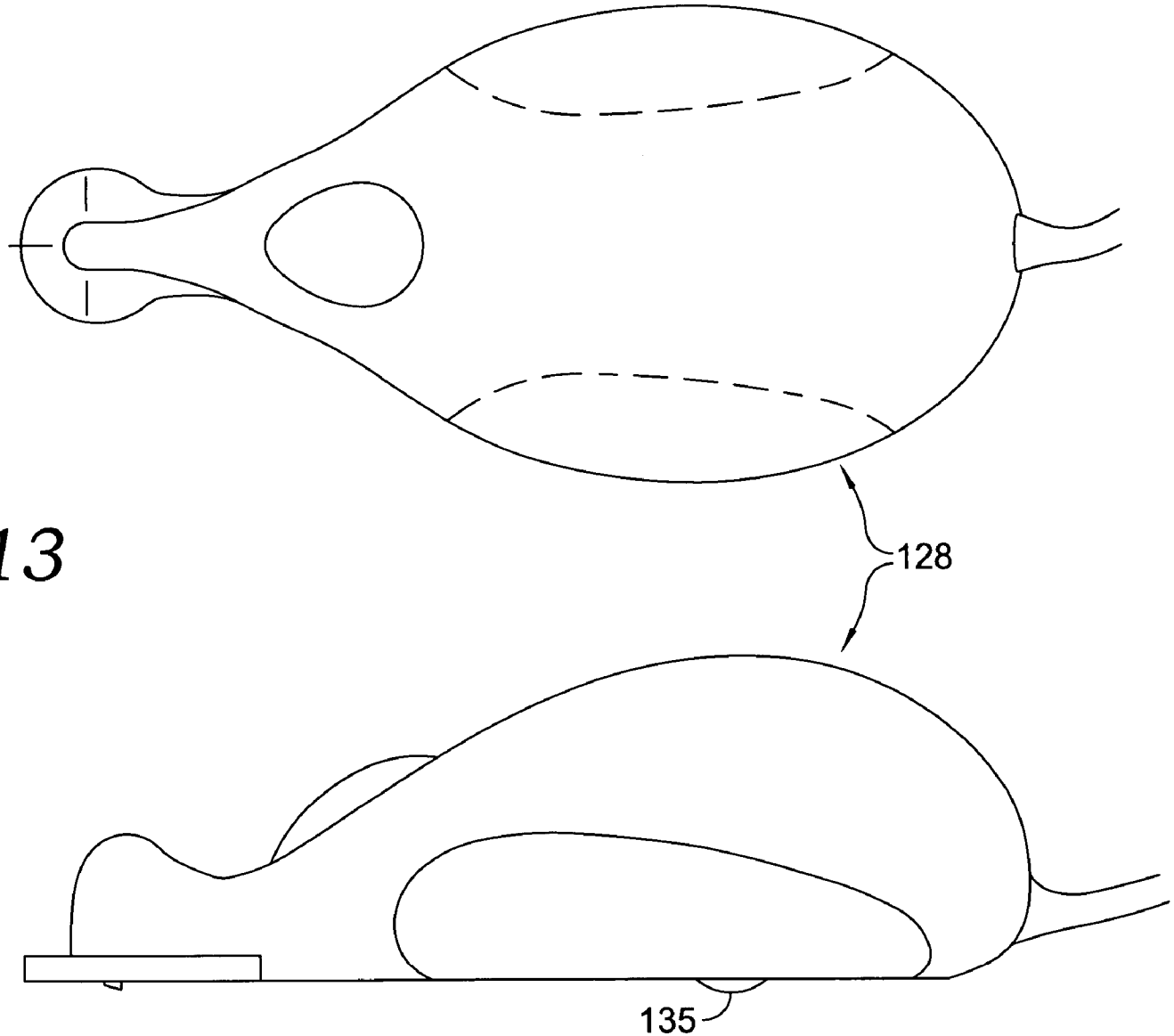
FIG. 13 includes additional views of the tool of FIG. 10.
Figure 14:
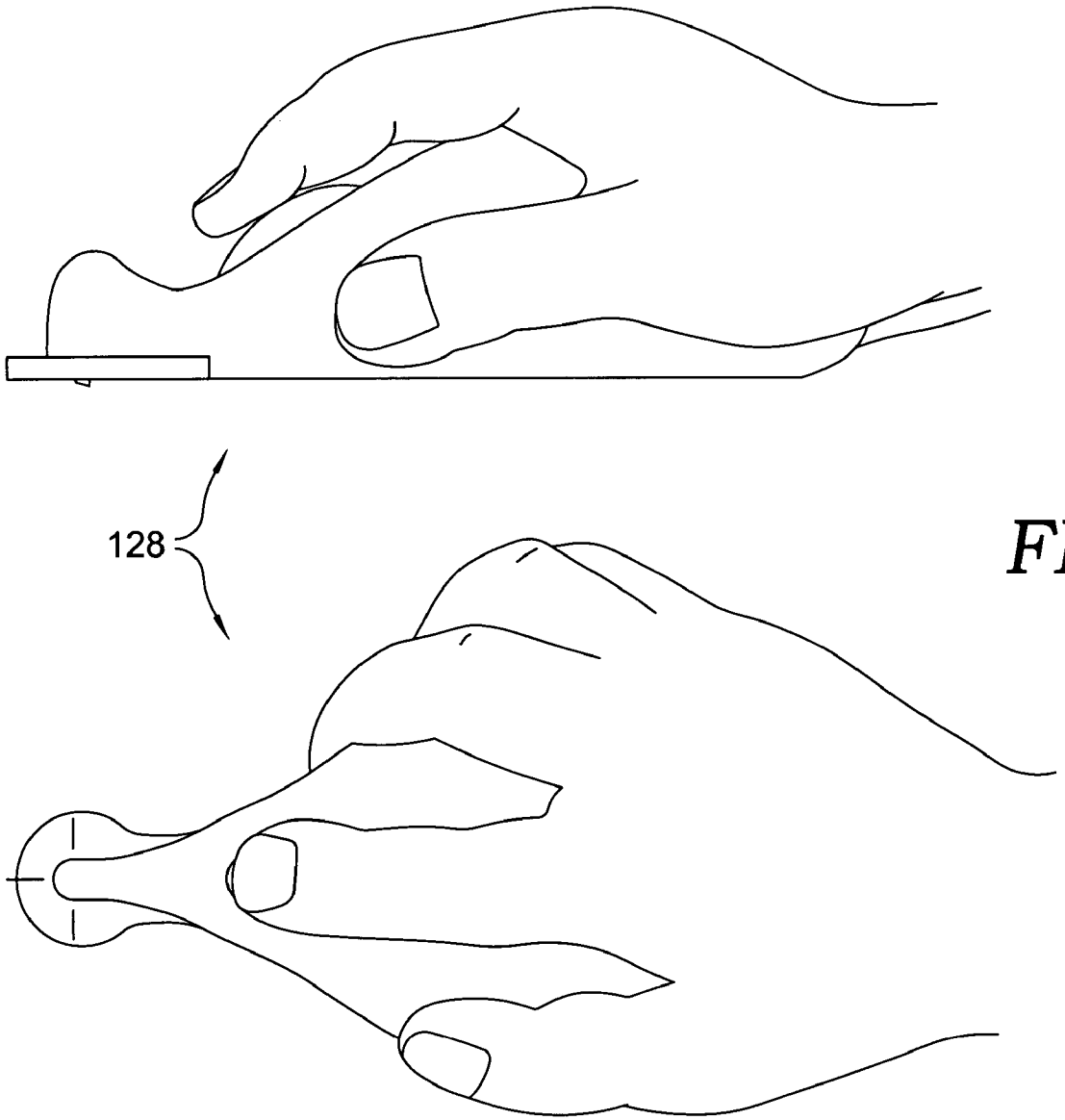
FIG. 14 includes additional views of the tool of FIG. 10 in use.

FIGS. 8 and 9 show an additional embodiment of a tool assembly 112 wherein housing 113 is disposed at an approximately sixty degree angle with respect to a cutting surface 115. As shown in FIG. 9, the tool assembly 112 includes the drive assembly 20, a generally triangularly shaped cam 114, a cutting or forming shaft 116, and a connection to a power supply 117. The triangular cam 114 is coupled with drive assembly 20 at a connection 118 and is coupled with the housing 113 at a connection 120. An intermediate shaft 122 couples the triangular cam 114 to the cutting shaft 116 at connection 124. In use, the drive assembly 20 causes the triangular cam 114 to pivot about connection 120, which in turn drives the cutting or forming shaft 116 in a reciprocal motion in the direction referenced by arrow 125.

FIGS. 10-14 show an additional embodiment of a tool assembly 126 wherein the tool assembly 126 has a housing 128 shaped generally like a computer mouse. The cutting tool assembly 126 comprises the drive assembly 20, a lever 130, and a cutting or forming shaft 132. The lever 130 is generally L-shaped and is coupled to the housing 128 at connection 134 and coupled to the drive assembly 20 at connection 138. The reciprocating shaft 132 is coupled to the lever 130 at slot 136. This embodiment may include one or more pressure switches 135 mounted to a bottom surface 129 of the housing 128. These switches 135 are electrically connected in series with a power switch 137. Both pressure switches must be engaged for the power switch to be operable to insure that the housing is placed on a flat, relatively hard surface prior to activation of the apparatus. In use, clicking the on/off switch 137 powers the drive assembly 20 to drive the cutting shaft 132. Specifically, the drive assembly 20 causes the lever 130 to pivot about connection 138 to drive the cutting shaft 132 in a generally perpendicular direction compared to the underlying cutting surface.

Figure 16:
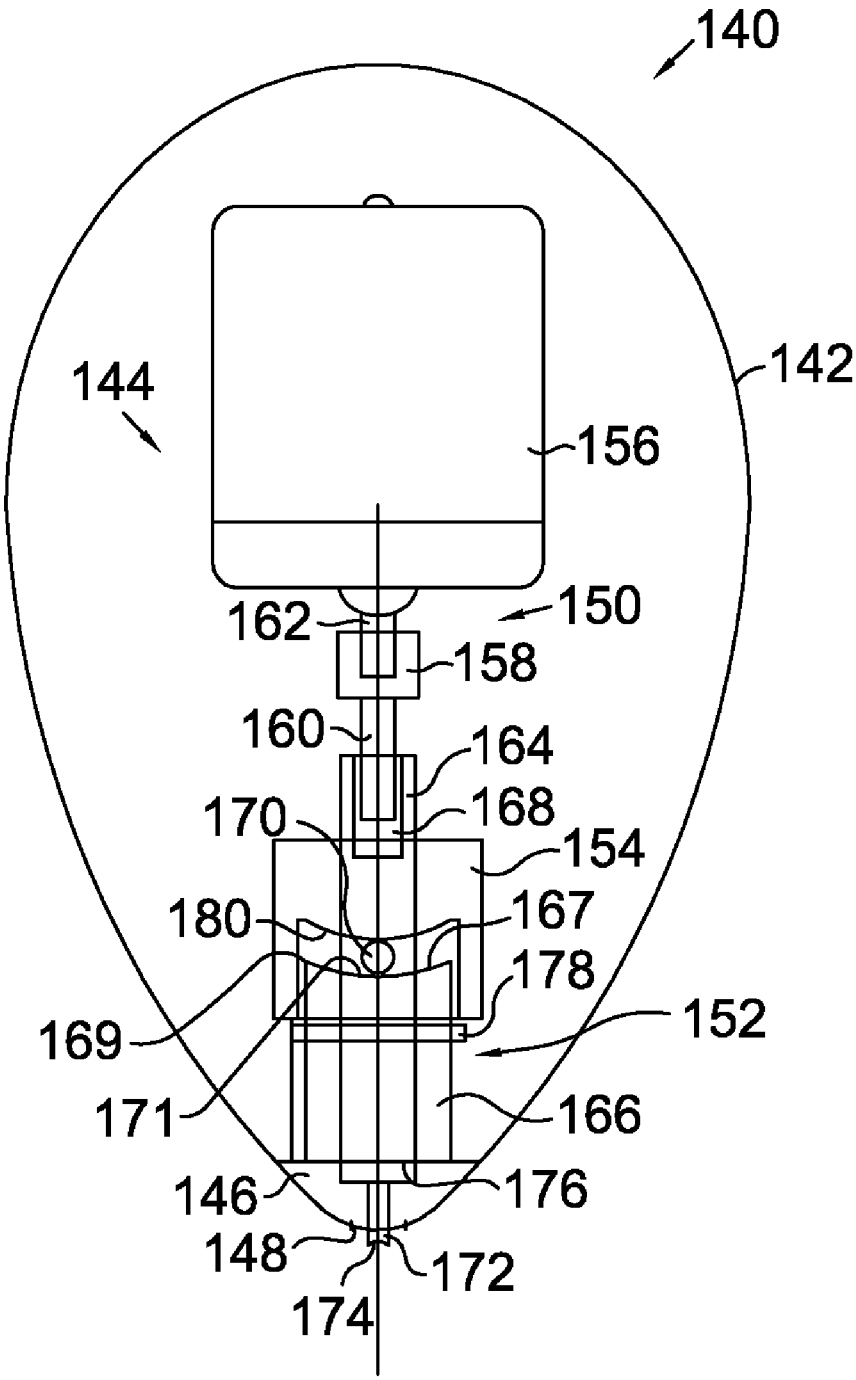
FIG. 16 is a view of an additional embodiment of an apparatus that spins and reciprocates.

FIG. 16 shows an additional embodiment of a cutting tool assembly 140, in which the tip simultaneously spins and reciprocates. The tool assembly 140 includes a housing 142 having a tip portion 146 with an opening 148. The assembly 140 further includes an inner mechanism 144 having a drive assembly 150, a shaft assembly 152, and a collar 154. The drive assembly 150 and the shaft assembly 152 are contained within the housing 142.

The drive assembly 150 may be battery or electrically powered and includes a motor 156, a drive shaft 158, and a drive coupler 160. In a battery powered embodiment, the batteries may be housed in housing 142 to provide a non-tethered, self-powered portable apparatus, or, alternatively, the batteries may be housed in an underlying board, which is discussed hereinafter, or a separate power base (not shown). The motor 156 includes an output axle 162 that is coupled to the drive shaft 158, which is coupled with the drive coupler 160. The drive coupler 160, in turn, is coupled with the shaft assembly 152.

The shaft assembly 152 includes a reciprocating shaft 164 and a shaft guide 166. Both the reciprocating shaft 164 and shaft guide 166 may be disposed vertically within the housing 142. The reciprocating shaft 164 is cylindrical and contains upper and lower portions. The upper portion comprises a socket 168 that receives the drive coupler 160 and a pair of guide members 170. The guide members 170 are opposed and project outwardly from the upper portion of the reciprocating shaft 164. The lower portion of the reciprocating shaft 164 comprises a cutting tip 172 that protrudes downwardly therefrom. The cutting tip 172 preferably has a concave bottom surface 174. As previously discussed, in an alternative embodiment, the shaft may be tubular and function as previously described and shown in FIG. 22.

The shaft guide 166 is cylindrical and defines an aperture 176 therethrough that is sized and configured to receive the reciprocating shaft 164. The shaft guide 166 may be disposed proximate the tip 146 of the housing 142 and contains a stop 178 that serves to limit to movement of the collar 154 when in use. The stop 178 projects radially outwardly from the outer surface along the circumference of the shaft guide 166.

Figure 24:
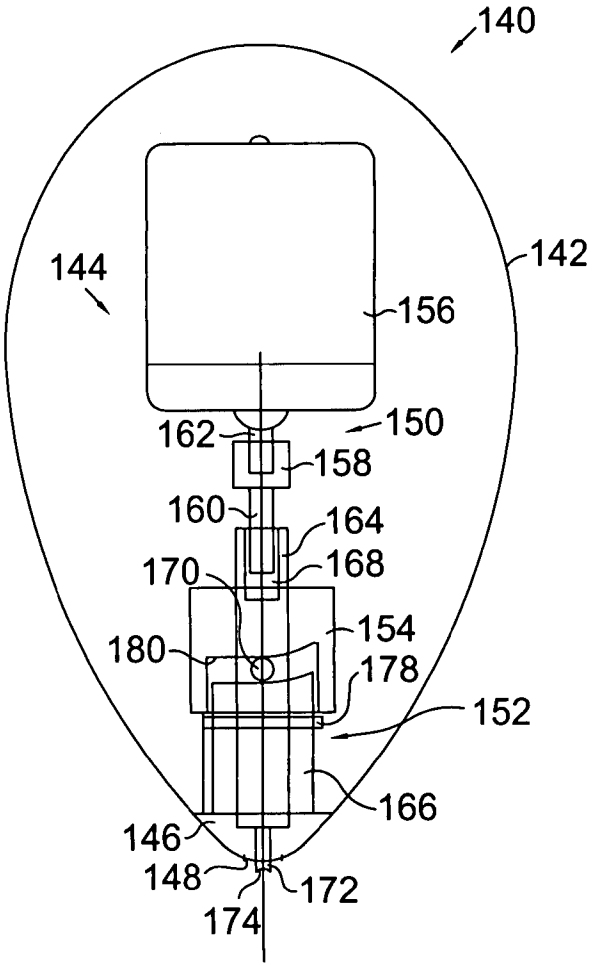
FIG. 24 is a view of an alternative embodiment of the embodiment shown in FIG. 16.

The shaft guide 166 further includes an upper surface 167 that is configured to have at least one raised portion 169 relative to the remainder of the upper surface. In the embodiment shown in FIG. 16, the upper surface 167 has two raised portions 169 and two troughs 171. The guide members 170 are configured to abut the upper surface 167 of the shaft guide and follow the undulating path of the upper surface. This causes the shaft to reciprocate as the shaft spins around its longitudinal axis. It will be understood that if greater torque is required, the upper surface may have a single raised portion and a single trough as shown in FIG. 24.

The collar 154 is cylindrical and is formed with a guide groove 180 on its inner surface that receives guide members 170 of the reciprocating shaft 164. The guide groove 180 is formed with a slight oscillation that follows the undulating upper surface 169 of the guide. As such, in use, the motor 156 causes the drive assembly 150 and, thus, the reciprocating shaft 164 to rotate. When the reciprocating shaft 164 rotates the guide members 170 follow the path of the upper surface 169 and guide groove 180 which causes the tip both to rotate axially and reciprocate longitudinally.

Figure 20:
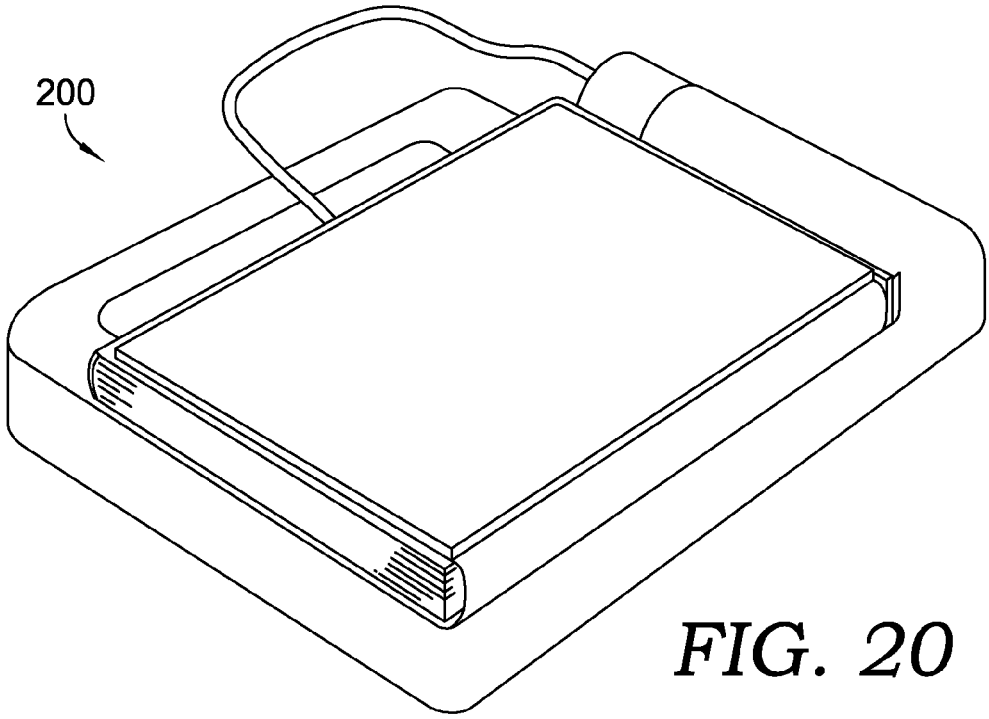
FIG. 20 includes additional views of an underlying board to be used with one embodiment of the apparatus of the present invention.
Figure 21:
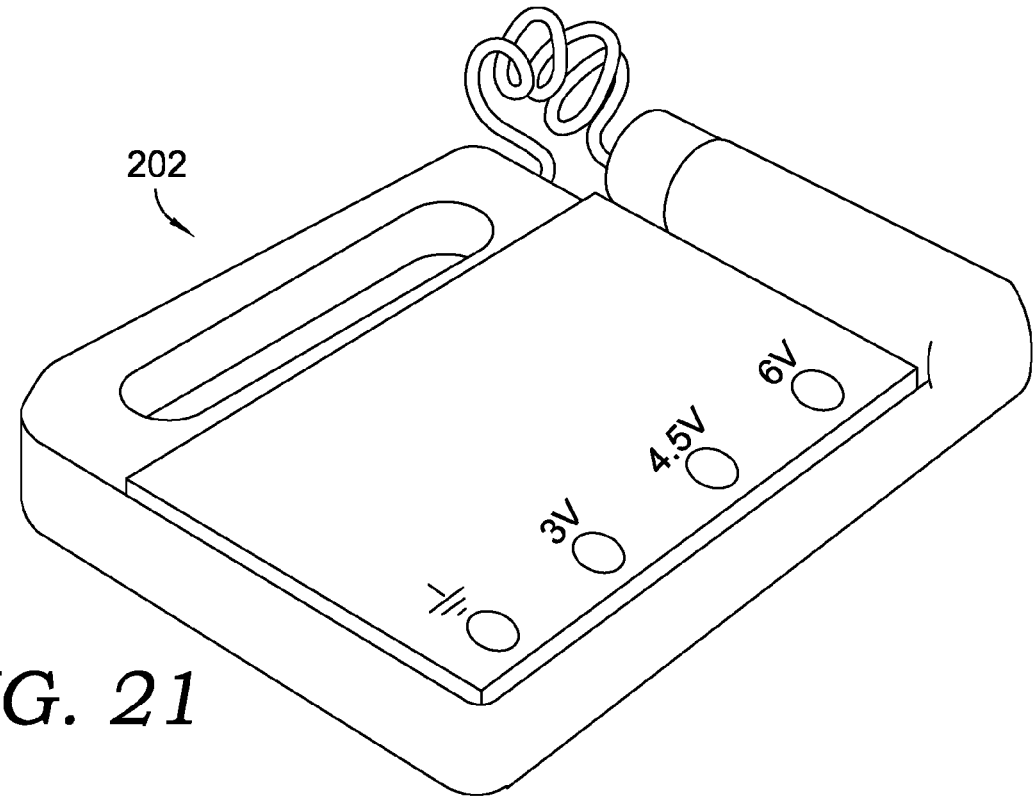
FIG. 21 is a view of a booklet on a housing for use with the tool assembly of the present invention.

All of these embodiments of a tool assembly may be used with an underlying board 200 or 202 as depicted in FIGS. 20 and 21. The board 200, 202 may supply power to the cutting tool and further may be configured with grooves (not shown) to facilitate the cutting certain shapes, such as, for example, circles, spirals anatomical features, wings and fuselage, and moon shapes. The underlying board 200, 202 may be plastic and may include means to secure the paper or other material to the board to facilitate the cutting of the material. In one means of securing the material, the underlying board 200, 202 may have a portion with increased frictional resistance to assist in securing the material. In an alternative method of practicing the invention, the material, such as paper, may be configured with a pressure sensitive adhesive around the periphery to retain the material on the underlying board or surface.

Figure 17:
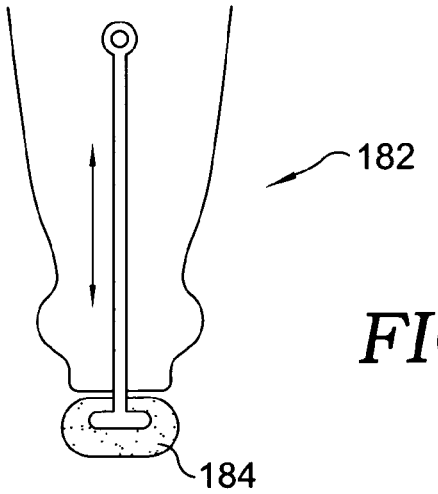
FIG. 17 is a view of an additional embodiment of an apparatus of the present invention showing a forming tool.
Figure 18:
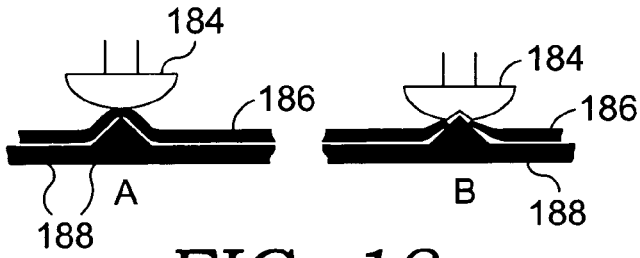
FIG. 18 includes additional views of the tool of FIG. 17 in use.
Figure 19:
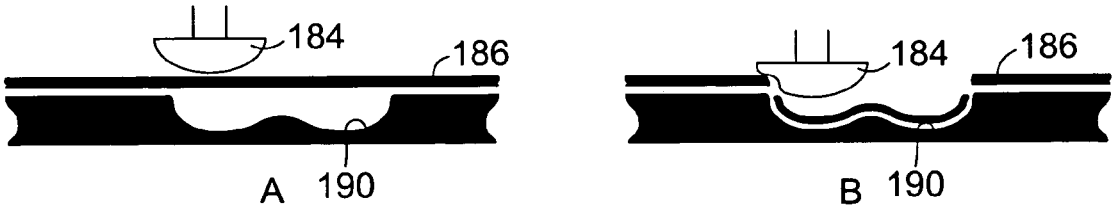
FIG. 19 includes additional views of the tool of FIG. 17 in use.

FIG. 17 shows an additional embodiment of a tool assembly 182 particularly useful in the forming of materials. The assembly 182 of FIG. 17 is similar to that disclosed in FIG. 8 with the exception that the tool 182 of FIG. 17 contains a soft forming tip 184, instead of a cutting tip. As shown in FIGS. 18 and 19, the reciprocating soft tip 184 and cutting board 200 of FIG. 20, may be used to force paper or other material 186 onto raised areas 188 or into slots 190 to create a variety of shapes. The graphics of the project sheet can align with the cutting and forming areas of the cutting board. Thus, there is little accuracy required to create precise shapes. This mechanism permits preschoolers to cut paper or other materials safely and accurately. Paper, wax paper, certain plastics and metal foil or any combination thereof can be used. The use of raised areas and slots 188, 190 further allow for the creation of foldable structures. By designing a cutting board with cavities and recessed areas, fold-up, fold-down, and sheared areas can be created. This method also prepares paper, so it can easily be manipulated to create a variety of structures such as airplanes, houses, characters, etc.

Additionally, the above-described tools can be used in a number of other types of applications. Specifically, the tools may be used for cutting or forming paper, wax paper, thin plastic, metal foil, and translucent or opaque sheets of Mylar or acetate. The dual-action mechanism also has the ability to cut through one page of a book, without damaging the underlying pages. Games may be created by objects being hidden under the top sheet of paper and found by cutting the top sheet in appropriate areas. There is an advantage for some applications to employ the mechanism with the adjustable tip protrusion, shown in FIG. 6, such as cutting through folded paper to create symmetrical patterns. Booklets with pages of material to be cut, rather than loose sheets of paper, offer convenient sequential supply of material. The booklets can have stories related to the cutouts, different types of games, and discovery play.

For example, the tool assembly having a forming tip may be used to form portions of metal foil, such as aluminum foil, together to produce thicker shapes to create three dimensional objects, such as, for example, jewelry, seasonal and thematic structures, parts for model kits, statues, and figures for a chess set. Further, cavities on the underlying board can have overlapping recessed areas to permit successive interlocking shapes that are attached to each other during the forming process, which may be useful for producing chains for jewelry.

In another application, a stack of differently colored paper sheets may be assembled. Sequential cutting of layers of paper at increasingly smaller cuts would provide a colorful three-dimensional structure.

Another application for the tool assembly 10 of the present invention is the creation of various electrical circuits. In this application, aluminum or metal foil may be cut using the tool assembly 10 of the present invention to create conductive connections. The metal foil replaces wires to create conductive paths between electrical components that are on pages of a book. These components may include radios, alarms, or other sound producing device. The components are connected through the aluminum foil connections to a power source on the board or book. Each booklet may contain the electrical components necessary to complete a project of the book. Each page of the booklet includes an assembly of layers of metal foil, paper, and acetate. This assembly permits the tool assembly of the present invention to cut through the paper and foil, but not the acetate. A multi-point flap with connections for the components may be used to finalize the circuit. The cover of the book may be formed with switches, pressure points in the form of piano keys, a speaker, radio tuners, or other devices that pertain to a particular project for the booklet. Various projects in separate booklets may likewise be combined. As shown in FIG. 21, a booklet housing may be used to provide electrical power to each booklet. The connections can be made in a variety of ways, including providing connections on the inside surface of the back cover of the booklet. The back cover is received in the housing to hold the booklets in place and provide the electrical connections necessary for the particular project.

Providing the booklets with power through the housing provides for other features for the booklets as well. For example, the booklets may now have backlighting or audio capabilities. Further, a booklet may have a motor connected to a rotating disc. The cutting tool assembly may be used on material mounted to the rotating disc to create rings, discs and spirals.

As described, the tool assembly of the present invention uses a reciprocating shaft, with or without, twisting or spinning action, and the use of an adjustable twist mechanism for adapting the tool for cutting or forming. This tool assembly has a maximum cyclic rate of approximately 3500 cycles (impacts) per minute. This cycle rate is accomplished by using a motor speed of 7000 RPM and a 2-1 reduction gear ratio. However, by employing an ultrasonic piezo crystal tool, the cyclic rate can be increased from 3500 cycles per minute (58 cycles per second), up to 50 kHz (50,000 cycles per second). The ultrasonic piezo crystal mechanism uses a high-frequency vibrating tip, in place of the motor, gears and connecting rod. The sound, feel and cutting action of the ultrasonic mechanism provides a high-tech product with high apparent value, at a price point similar to the previously described motor-driven mechanism. The ultrasonic tool can be used for welding of materials, as well as cutting and forming.

The ultrasonic tool does not require a dedicated cutting board, and may have the batteries located within the housing. The freedom of motion has many advantages. The ultrasonic tip only moves a few thousandths of an inch. The motion of the ultrasonic tip can employ orbital motion, in order to permit the ultrasonic tool to be functional at angles other than 90 degrees.

A significant feature of the ultrasonic tool is that it can be used for cutting pages that remain in books. The paper does not have to be laid on a resilient cutting surface, to be cut. Newspapers, magazines, and comic books, that are normally discarded after reading, provide excellent material for ultrasonic tool. Paper from these sources has a wide variety of graphics that can be used as cut-outs.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An apparatus for one of cutting and forming material, the apparatus comprising, a housing;

a drive assembly substantially contained within the housing, the drive assembly comprising a motor connected to a power supply;

a shaft coupled to the drive assembly, the drive assembly imparting reciprocating motion to the shaft comprising a downward stroke and an upward stroke, the shaft further comprising one or more guide members extending axially outwardly from the shaft; and a shaft guide for imparting rotational movement to the shaft around a longitudinal axis of the shaft, the shaft guide having one or more guide grooves operably configured to receive the one or more guide members of the shaft, the one or more guide grooves extending downwardly from an upper edge of the shaft guide and having at least a curvilinear portion.

2. The apparatus of claim 1, wherein the shaft is mounted in the housing and terminates in a tip, the tip of the shaft protruding from the housing at some portion of the downward stroke of the shaft.

3. The apparatus of claim 2, wherein the tip is a cutting tip and comprises a concave bottom surface.

4. The apparatus of claim 2, wherein the tip is a forming tip, the forming tip being made of a soft tip for forming material.

5. The apparatus of claim 1, wherein the curvilinear portion of the guide grooves is generally parabolic and wherein the apparatus further comprises an axial rotation adjustment assembly, the axial rotation adjustment assembly comprising a collar that is movable along the length of the shaft guide to control the portion of the guide grooves in which the guide members reciprocate.

6. The apparatus of claim 5, wherein the axial rotation adjustment assembly controls the degree of rotation for the shaft from between approximately 0 degrees of axial rotation of the shaft to approximately 45 degrees of axial rotation.

7. The apparatus of claim 1, further comprising:

an attachment assembly for coupling the drive assembly to the shaft, the attachment assembly having a shaft attachment portion for rotatably securing the shaft to the drive assembly.

8. The apparatus of claim 1, wherein the housing is generally pen-shaped.

9. The apparatus of claim 1, wherein a portion of the housing extends at an approximately 60 degrees angle from an underlying surface.

10. The apparatus of claim 1, wherein the housing extends substantially parallel to an underlying surface.

11. The apparatus of claim 1, further comprising:

a retraction mechanism for retracting the shaft inside the housing as the drive assembly is disengaged from the power supply.

12. The apparatus of claim 1, further comprising:

a shaft force limiting means to limit the force of the shaft as it exits the housing.

* * * * *